US009970621B2

(12) United States Patent
Yamanaka et al.

(10) Patent No.: US 9,970,621 B2
(45) Date of Patent: May 15, 2018

(54) LIGHTING APPARATUS HAVING ELECTRODES THAT CHANGE THE FOCAL POSITION ON A WAVELENGTH CONVERSION ELEMENT, VEHICLE HAVING THE SAME AND METHOD OF CONTROLLING THE SAME

(71) Applicant: Panasonic Intellectual Property Management Co., Ltd., Osaka (JP)

(72) Inventors: Kazuhiko Yamanaka, Toyama (JP); Kiyoshi Morimoto, Osaka (JP); Yoshihisa Nagasaki, Osaka (JP); Seigo Shiraishi, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 189 days.

(21) Appl. No.: 14/997,445

(22) Filed: Jan. 15, 2016

(65) Prior Publication Data

US 2016/0131321 A1 May 12, 2016

Related U.S. Application Data

(63) Continuation of application No. PCT/JP2014/003339, filed on Jun. 23, 2014.

(30) Foreign Application Priority Data

Aug. 7, 2013 (JP) ..... 2013-163881

(51) Int. Cl.
*F21S 41/663* (2018.01)
*F21S 41/25* (2018.01)
*F21S 8/10* (2006.01)

(52) U.S. Cl.
CPC ..... *F21S 48/1731* (2013.01); *F21S 41/14* (2018.01); *F21S 41/25* (2018.01); *F21S 41/645* (2018.01); *F21S 41/663* (2018.01)

(58) Field of Classification Search
CPC ..... G02B 3/12; G02B 3/14; F21V 14/003; B60Q 1/064; B60Q 1/076; B60Q 1/08;
(Continued)

(56) References Cited

U.S. PATENT DOCUMENTS

2011/0249460 A1 10/2011 Kushimoto
2014/0049945 A1* 2/2014 Yeh ..... F21V 5/048 362/101
2015/0124466 A1 5/2015 Kushimoto

FOREIGN PATENT DOCUMENTS

JP 2008-187065 8/2008
JP 2011-222238 11/2011
(Continued)

OTHER PUBLICATIONS

International Search Report of PCT application No. PCT/JP2014/003339 dated Aug. 19, 2014.

*Primary Examiner* — Anh Mai
*Assistant Examiner* — Steven Horikoshi
(74) *Attorney, Agent, or Firm* — McDermott Will & Emery LLP

(57) ABSTRACT

The present disclosure aims to enhance controllability of a lighting apparatus and increase durability. A lighting apparatus includes a light source; a condenser that converges first light emitted from the light source onto a predetermined focal position of a wavelength conversion element as converged light; the wavelength conversion element that receives the converged light and emits second light at an emission point; and a projection lens that projects the second light as projection light. The lighting apparatus changes the focal position of the condenser lens to change the emission
(Continued)

point of the second light to the projection lens, thereby being capable of projecting the second light in any direction.

6 Claims, 19 Drawing Sheets

(58) Field of Classification Search
CPC ..... B60Q 1/085; B60Q 2300/41; B60Q 2300/42; F21S 48/115–48/1159; F21S 48/1731; F21S 48/1736; F21S 48/1747; F21S 41/14; F21S 41/141; F21S 41/143; F21S 41/147; F21S 41/16; F21S 41/24; F21S 41/25; F21S 41/255; F21S 41/27; F21S 41/645; F21S 41/65; F21S 41/663; F21S 10/00–10/005
See application file for complete search history.

(56) References Cited

FOREIGN PATENT DOCUMENTS

| | | |
|---|---|---|
| JP | 2012-069409 | 4/2012 |
| JP | 2012-221634 | 11/2012 |
| JP | 2013-037252 | 2/2013 |
| JP | 2013-250369 | 12/2013 |

* cited by examiner

LIGHTING APPARATUS HAVING ELECTRODES THAT CHANGE THE FOCAL POSITION ON A WAVELENGTH CONVERSION ELEMENT, VEHICLE HAVING THE SAME AND METHOD OF CONTROLLING THE SAME

BACKGROUND OF THE INVENTION

1. Field of the Invention

The present disclosure relates to a lighting apparatus which utilizes light generated through irradiation of light, which is emitted from a light source, to a wavelength conversion element; a vehicle; and a method for controlling light distribution of the lighting apparatus.

2. Description of the Related Art

As illustrated in FIG. 20, a conventional lighting apparatus capable of controlling light distribution includes laser device 1032 and MEMS (Micro Electro Mechanical Systems) mirror 1033 which reflects light emitted from laser device 1032 and is tiltable two-dimensionally tilt. The conventional lighting apparatus also includes phosphor panel 1034 carrying phosphor 1342 which receives light reflected on MEMS mirror 1033 and emits white light, and projection lens 1040 which projects the white light emitted from phosphor panel 1034 toward front of a vehicle. The conventional lighting apparatus also includes a controller that scans light, which is emitted from laser device 1032 and reflected on MEMS mirror 1033, on phosphor panel 1034 with a predetermined scanning pattern by controlling lighting intensity of laser device 1032 and a tilting angle and tilting direction of MEMS mirror 1033.

PTL 1 has been known as prior art document information relating to this application, for example.

CITATION LIST

Patent Literature

PTL 1: Unexamined Japanese Patent Publication No. 2011-222238

The conventional lighting apparatus described above has a problem of poor durability.

Specifically, the above conventional lighting apparatus is configured to use a MEMS mirror which is a mechanical component for controlling light distribution. The MEMS mirror moves a mirror with electrostatic power applied to an electrode formed on the movable mirror. Such mechanical component is worn with long-term use, so that controllability of the lighting apparatus is deteriorated, and durability is lowered.

SUMMARY OF THE INVENTION

In view of this, the present disclosure aims to enhance durability of a lighting apparatus having a wavelength conversion element and a condenser lens, and a vehicle using the lighting apparatus.

In order to solve the foregoing problem, the lighting apparatus according to the present disclosure includes: a light source; a wavelength conversion element that receives first light emitted from the light source and emits second light; a condenser that converges the first light onto a predetermined focal position of the wavelength conversion element; a projection lens that projects the second light; and a plurality of electrodes that change the focal position with a control signal.

This configuration enables changing of the place where the first light is converged on the wavelength conversion element without using a mechanical component. Consequently, durability of the lighting apparatus can be enhanced.

Preferably, in the lighting apparatus according to the present disclosure, the plurality of electrodes are disposed on the condenser.

Preferably, in the lighting apparatus according to the present disclosure, the plurality of electrodes are formed on a plane perpendicular to a principal axis of the first light.

Preferably, in the lighting apparatus according to the present disclosure, the plurality of electrodes are disposed at the light source.

Preferably, in the lighting apparatus according to the present disclosure, the light source has a plurality of optical waveguides, and the plurality of electrodes are respectively connected to the plurality of optical waveguides.

Preferably, in the lighting apparatus according to the present disclosure, the wavelength conversion element includes a plurality of segmented light conversion portions.

Preferably, in the lighting apparatus according to the present disclosure, the optical conversion portion has a phosphor.

Preferably, in the lighting apparatus according to the present disclosure, the condenser includes a collimator lens and a condenser lens.

A vehicle according to the present disclosure preferably has the above lighting apparatus.

Preferably, a method for controlling a lighting apparatus according to the present disclosure includes: providing the lighting apparatus with a controller that independently supplies power to the plurality of electrodes; and changing an amount of power to be supplied to the plurality of electrodes.

According to the present disclosure, the place where the first light is converged on the wavelength conversion element can be changed without using a mechanical component. Consequently, durability of the lighting apparatus can be enhanced.

DETAILED DESCRIPTION OF THE PREFERRED EMBODIMENTS

Exemplary embodiments of the present disclosure will be described with reference to the drawings.

First Exemplary Embodiment

A lighting apparatus and a method for controlling the lighting apparatus according to a first exemplary embodiment of the present disclosure will be described below with reference to the drawings.

Figure 1:
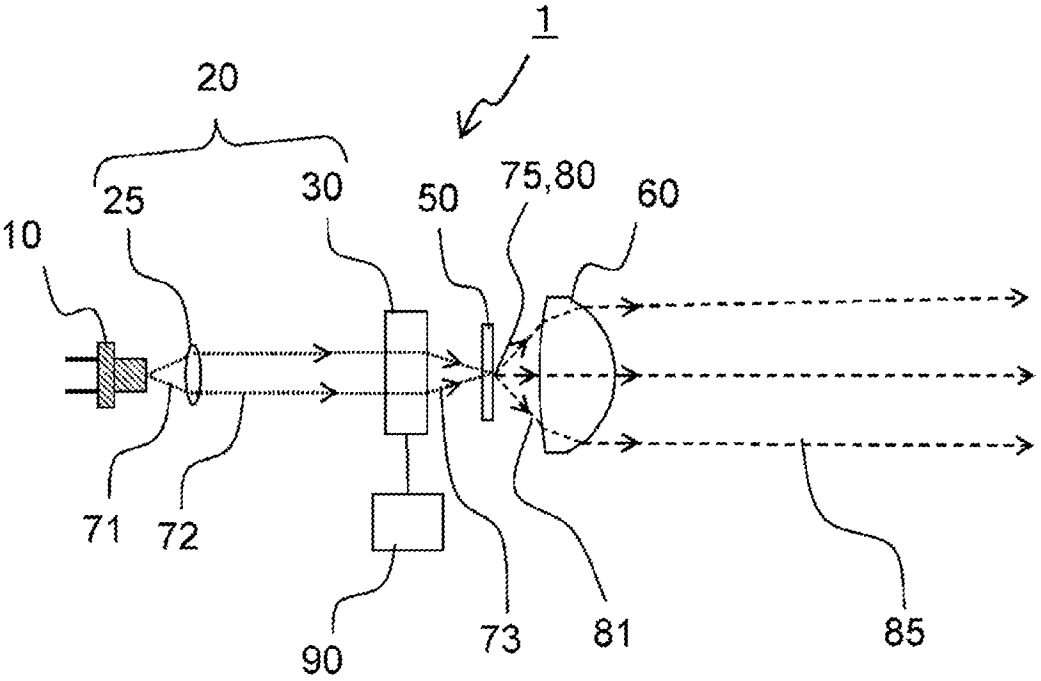
FIG. 1 is a schematic sectional view illustrating a configuration of a lighting apparatus according to a first exemplary embodiment of the present disclosure.

As illustrated in FIG. 1, lighting apparatus 1 according to the first exemplary embodiment of the present disclosure includes: light source 10; condenser 20 that converges first light 71 emitted from light source 10 onto predetermined focal position 75 of wavelength conversion element 50 as converged light 73; wavelength conversion element 50 that receives converged light 73 and emits second light 81 at emission point 80; and projection lens 60 that projects second light 81 as projection light 85.

Condenser 20 includes one or more lenses. In the present exemplary embodiment, condenser 20 includes collimator lens 25 and condenser lens 30.

Figure 2:
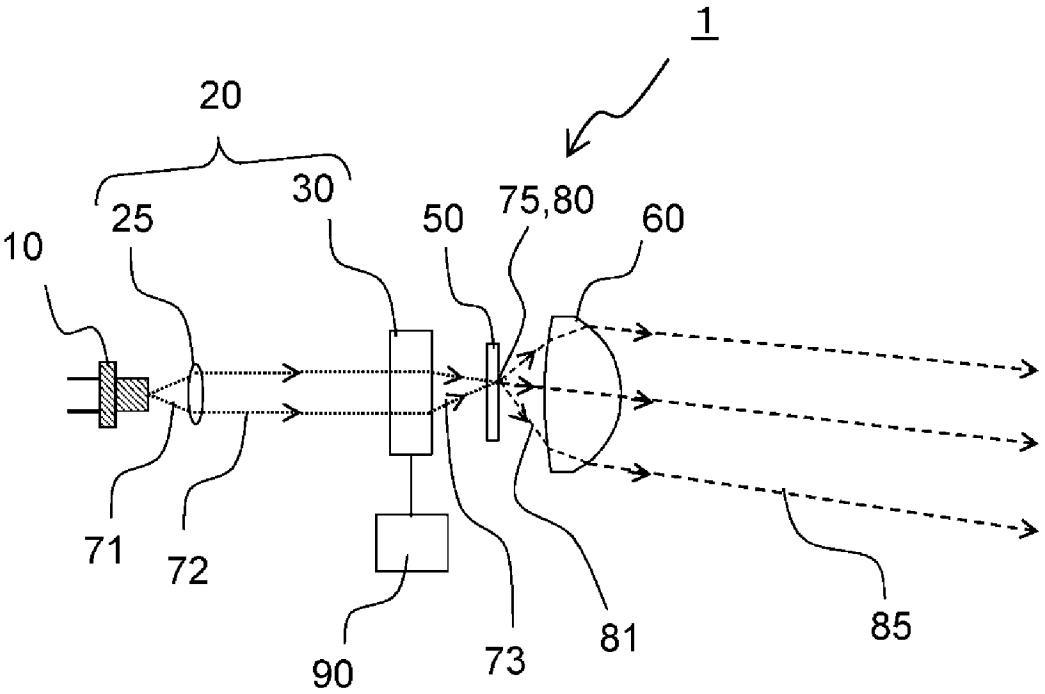
FIG. 2 is a schematic sectional view illustrating a configuration and operation of the lighting apparatus.

As illustrated in FIG. 2, lighting apparatus 1 changes focal position 75 of condenser lens 30 to change the position of emission point 80 of second light 81 to projection lens 60, thereby being capable of projecting second light 81 in any direction.

More specific description will be made below.

(Method for Generating Second Light)

As illustrated in FIG. 1, lighting apparatus 1 converges first light 71 emitted from light source 10 to wavelength conversion element 50 with condenser 20, radiates this light from wavelength conversion element 50 as second light 81, and projects radiated second light 81 with projection lens 60.

Firstly, wavelength conversion element 50 that radiates second light 81 will be described. In the present exemplary embodiment, it is supposed that a wavelength of first light 71 ranges from 380 nm to 499 nm.

When first light 71 has a wavelength ranging from 420 nm to 499 nm, wavelength conversion element 50 can be formed by dispersing yellow phosphor having a main emission wavelength ranging from 540 nm to 610 nm and having an emission wavelength up to 660 nm into a transparent substrate, or by forming the yellow phosphor on a transparent substrate as a phosphor layer. Examples of materials used for the transparent substrate include silicone, low-melting-point glass, transparent ceramic, sapphire, and zinc oxide. The transparent base is formed such that a phosphor material is laminated as a phosphor layer using silicone, low-melting-point glass, and zinc oxide as binder. The phosphor material described below may be sintered to be used as the transparent substrate. When wavelength conversion element 50 described above is used, the material of the phosphor of wavelength conversion element 50, concentration of the distributed phosphor or concentration of the phosphor in the phosphor layer, or the formation position of the phosphor layer is controlled to adjust an intensity ratio between first light 71 and radiation light from the yellow phosphor. This results in allowing second light 81 emitted from wavelength conversion element 50 described above to be white light having a main wavelength ranging from 420 nm to 660 nm. Examples of usable yellow phosphor include Ce-activated YAG phosphor ($(Y, Gd)_3(Al, Ga)_5O_{12}$:Ce), Eu-activated alpha-SiAlON phosphor, and Eu-activated $(Ba, Sr)Si_2O_2N_2$ phosphor.

The phosphor is not limited to one type as described above. For example, red phosphor having a main emission wavelength ranging from 590 nm to 660 nm and green phosphor having a main emission wavelength ranging from 500 nm to 590 nm may be mixed to generate white light.

Examples of usable red phosphor include Eu-activated $(Sr, Ca)AlSiN_3$ phosphor, and Eu-activated $CaAlSiN_3$ phosphor. Examples of usable green phosphor include Ce-activated $Lu_3Al_5O_{12}$ phosphor, Eu-activated beta SiAlON phosphor, Eu-activated $SrSi_2O_2N_2$ phosphor, and Eu-activated $(Ba, Sr)Si_2O_2N_2$ phosphor.

When first light 71 has a wavelength ranging from 380 nm to 430 nm, wavelength conversion element 50 can be formed by dispersing red phosphor having a main emission wavelength ranging from 590 nm to 660 nm, green phosphor having a main emission wavelength ranging from 500 nm to 590 nm, and blue phosphor having a main emission wavelength ranging from 430 nm to 500 nm into a transparent substrate, or by forming these phosphors on a transparent substrate as a phosphor layer. Wavelength conversion element 50 described above is used, and intensity ratio of radiation lights from the above red, green, and blue phosphors is adjusted. With this, second light 81 having high color rendering properties and wavelength ranging from 430 nm to 660 nm can be generated. Examples of usable blue phosphor include Eu-activated $BaMgAl_{10}O_{17}$ phosphor, Eu-activated $Sr_3MgSi_2O_8$ phosphor, and Eu-activated $Sr_5(PO_4)_3Cl$ (SCA) phosphor. Examples of usable red phosphor include Eu-activated $(Sr, Ca)AlSiN_3$ phosphor and Eu-activated $CaAlSiN_3$ and also $Y_2O_2S:Eu^{3+}$ phosphor.

Notably, when the wavelength of first light 71 ranges from 380 nm to 420 nm, a combination of blue phosphor having a main emission wavelength ranging from 430 nm to 500 nm and yellow phosphor having a main emission wavelength ranging from 540 nm to 610 nm and having an emission wavelength up to 700 nm may be used.

(Method for Controlling Second Light)

A method for controlling the lighting apparatus will next be described.

Lighting apparatus 1 for a vehicle illustrated in FIG. 1 includes light source 10, wavelength conversion element 50 that receives first light 71 emitted from light source 10 and emits second light 81, and condenser lens 30 that converges first light 71 to wavelength conversion element 50. Lighting apparatus 1 also includes controller 90 that changes focal position 75 of condenser lens 30 by applying a control signal to a plurality of electrodes formed on condenser lens 30. A control circuit is incorporated in controller 90. Controller 90 may be incorporated as one module together with light source 10, wavelength conversion element 50, and condenser 20, or may be provided separately from light source 10, wavelength conversion element 50, and condenser 20.

Figure 3:
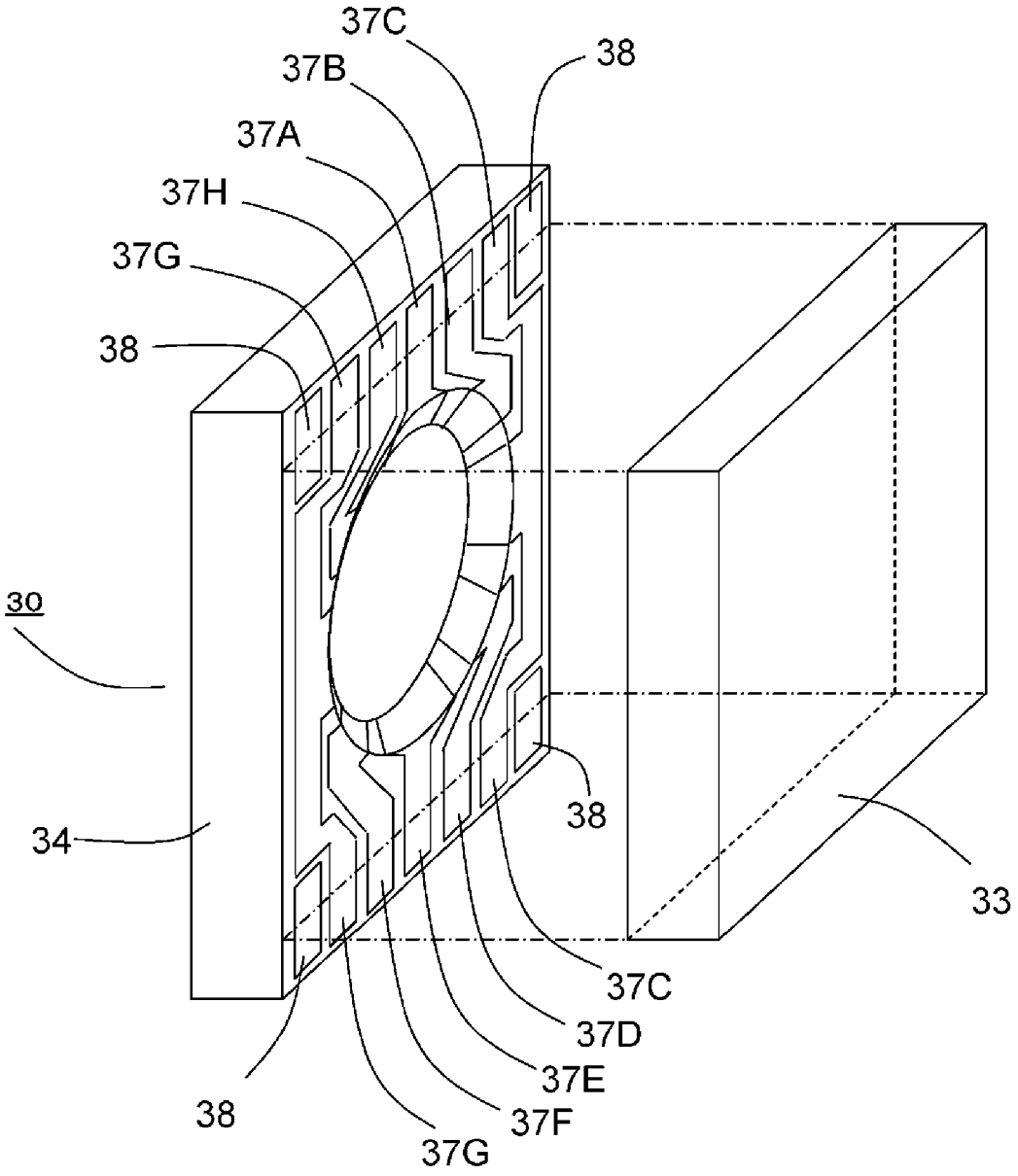
FIG. 3 is a schematic perspective view illustrating a neighborhood of a condenser lens in the lighting apparatus.
Figure 4:
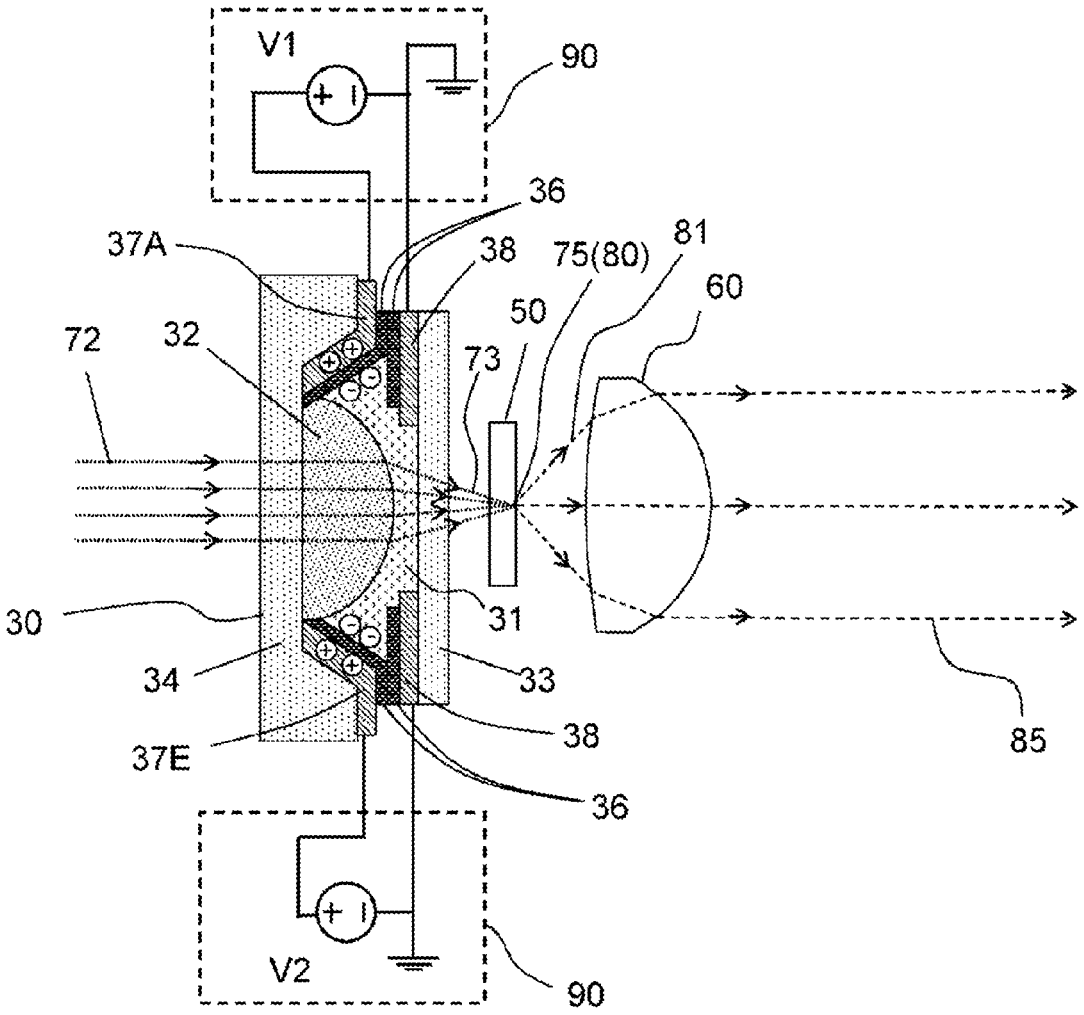
FIG. 4 is a schematic sectional view illustrating a configuration around an optical system in the lighting apparatus.
Figure 5:
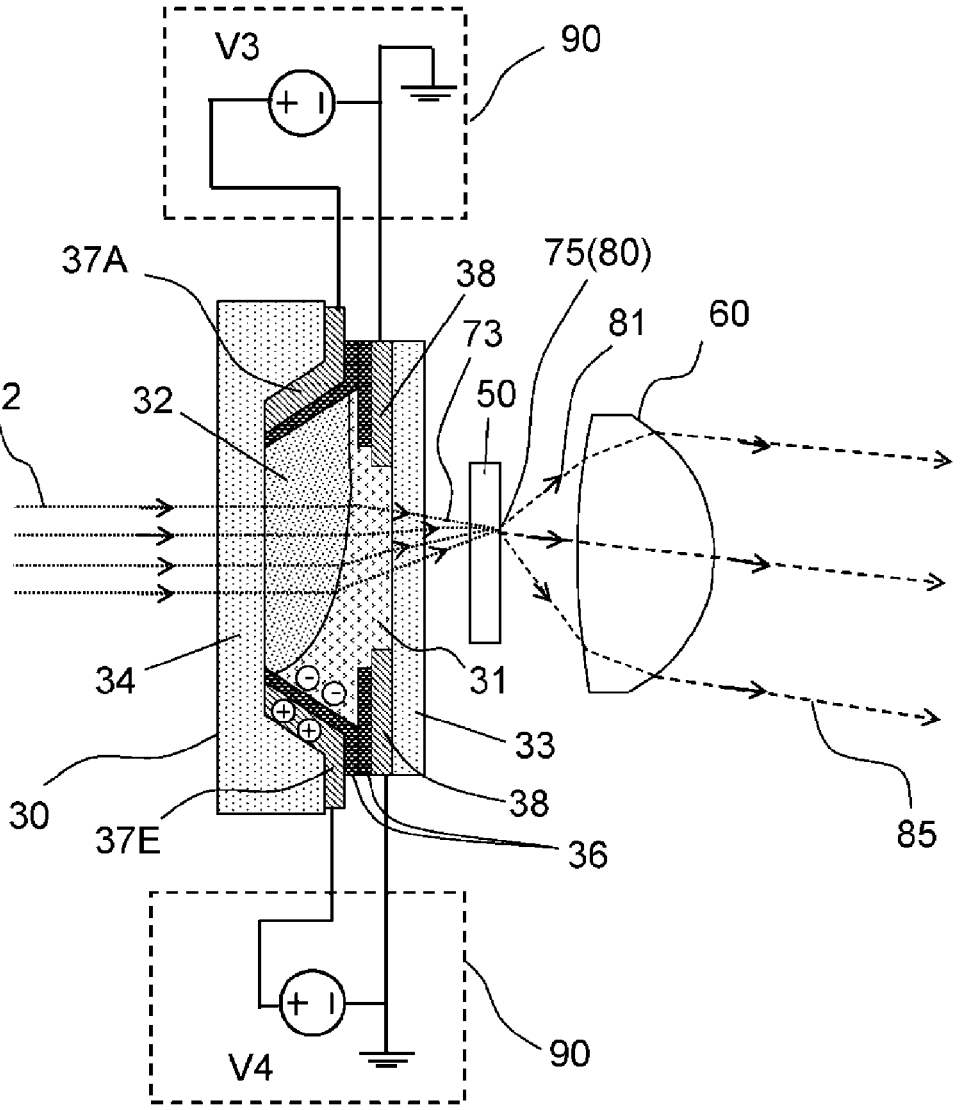
FIG. 5 is a schematic sectional view illustrating a configuration around the optical system in the lighting apparatus and an operation thereof.

The change in the focal position of condenser lens 30 will be described more specifically below with reference to FIGS. 3 to 5. FIG. 3 illustrates a configuration of a plurality of electrodes formed on condenser lens 30. FIG. 4 illustrates an arrangement relation among condenser lens 30, wavelength conversion element 50, projection lens 60, and other components, when first light 72 (converged light 73) is converged on almost a center of wavelength conversion element 50. FIG. 5 illustrates an arrangement relation among condenser lens 30, wavelength conversion element 50, projection lens 60, and other components, when first light 72 (converged light 73) is converged on a position shifted from the center of wavelength conversion element 50.

In FIGS. 3 to 5, condenser lens 30 includes first transparent substrate 33 and second transparent substrate 34 opposite to first transparent substrate 33. Condenser lens 30 also includes a common electrode (not illustrated) at an outer periphery of first transparent substrate 33. As shown in FIG. 3, condenser lens 30 includes, at an outer periphery of second transparent substrate 34, first electrode 37A, second electrode 37B, third electrode 37C, fourth electrode 37D, fifth electrode 37E, sixth electrode 37F, seventh electrode 37G, eighth electrode 37H, and common electrode 38 connected to the common electrode (not illustrated) formed on first transparent substrate 33.

For condenser lens 30 illustrated in FIG. 3 and having the plurality of fixed electrodes, voltages applied to third electrode 37C and common electrode 38; fourth electrode 37D and common electrode 38; fifth electrode 37E and common electrode 38; sixth electrode 37F and common electrode 38; seventh electrode 37G and common electrode 38; and eighth electrode 37H and common electrode 38 are independently changed for changing focal position 75 in FIG. 1 with a control signal. With this change, lighting apparatus 1 changes focal position 75 of condenser lens 30 to change the position of emission point 80 of second light 81 to projection lens 60, thereby being capable of projecting second light 81 in any direction.

As illustrated in FIGS. 3, 4, and 5, first liquid 31 and second liquid 32 are placed in a region enclosed by first transparent substrate 33 and second transparent substrate 34. Insulating film 36 is formed on a contact surface where first electrode 37A contacts first liquid 31 and second liquid 32, a contact surface where second electrode 37B contacts first liquid 31 and second liquid 32, a contact surface where third electrode 37C contacts first liquid 31 and second liquid 32, a contact surface where fourth electrode 37D contacts first liquid 31 and second liquid 32, a contact surface where fifth electrode 37E contacts first liquid 31 and second liquid 32, a contact surface where sixth electrode 37F contacts first liquid 31 and second liquid 32, a contact surface where seventh electrode 37G contacts first liquid 31 and second liquid 32, and a contact surface where eighth electrode 37H contacts first liquid 31 and second liquid 32.

Although not illustrated, a second insulating film (not illustrated) is formed between first electrode 37A and second electrode 37B and between third electrode 37C and fourth electrode 37D. With the formation of the second insulating film (not illustrated), voltage between first electrode 37A and second electrode 37B and voltage between third electrode 37C and fourth electrode 37D can individually be controlled.

Although not illustrated, a second insulating film (not illustrated) is formed between fifth electrode 37E and sixth electrode 37F and between seventh electrode 37G and eighth electrode 37H. With the formation of the second insulating film (not illustrated), voltage between fifth electrode 37E and sixth electrode 37F and voltage between seventh electrode 37G and eighth electrode 37H can individually be controlled.

First light 72 enters condenser lens 30 thus configured, and wavelength conversion element 50 receives first light 72 (converged light 73) converged by condenser lens 30, and emits second light 81.

First liquid 31 and second liquid 32 have different refractive indices. First liquid 31 and second liquid 32 are located separately at the side of first transparent substrate 33 and at the side of second transparent substrate 34 without being mixed. Conductive aqueous solution can be used for first liquid 31, and non-conductive silicon oil can be used for second liquid 32, for example. Especially when vehicle 100 is used in cold area, it is desirable to use antifreeze liquid for first liquid 31 and second liquid 32. For example, it is desirable to use ethylene glycol for first liquid 31 and immersion oil for second liquid 32.

It is supposed below that the refractive index of second liquid 32 is larger than the refractive index of first liquid 31.

When first voltage V1 (e.g., 40V) is applied among first electrode 37A, second electrode 37B, third electrode 37C, fourth electrode 37D, fifth electrode 37E, sixth electrode 37F, seventh electrode 37G, eighth electrode 37H, and common electrode (counter electrode) 38, first liquid 31 is drawn toward the plurality of peripheral electrodes (all of first electrode 37A to eighth electrode 37H). With the motion of first liquid 31, second liquid 32 is concentrated in the direction of the center of condenser lens 30. As a result, a curvature of a curved plane where first liquid 31 and second liquid 32 having different refractive indices contact becomes large. Therefore, first light 72 can be converged at almost the center of wavelength conversion element 50 by appropriately adjusting the applied voltage.

On the other hand, as illustrated in FIG. 5, for example, different voltages are applied between first electrode 37A and common electrode (counter electrode) 38 and between fifth electrode 37E and common electrode 38. The voltage applied to fifth electrode 37E is specified to be larger than the voltage applied to first electrode 37A here. With this, as shown in FIG. 5, the shape of the curve of the curved plane where first liquid 31 and second liquid 32 contact becomes such that the curvature at the side of first electrode 37A becomes smaller and the curvature at the side of fifth electrode 37E becomes larger. Specifically, the curvature of the curved plane of second liquid 32 at the side of fifth electrode 37E to which large voltage is applied becomes large, and the curvature of the curved plane of second liquid 32 at the side of first electrode 37A to which small voltage is applied becomes small. With this, first light 71 can be focused on the portion above the center of wavelength conversion element 50. As described above, the focal position of first light 72 on wavelength conversion element 50 can be changed from moment to moment, whereby the position of emission point 80 from which second light 81 is radiated can be changed, and projection direction of projection light can freely be changed with projection lens 60.

(Example of Vehicle)

Figure 6:
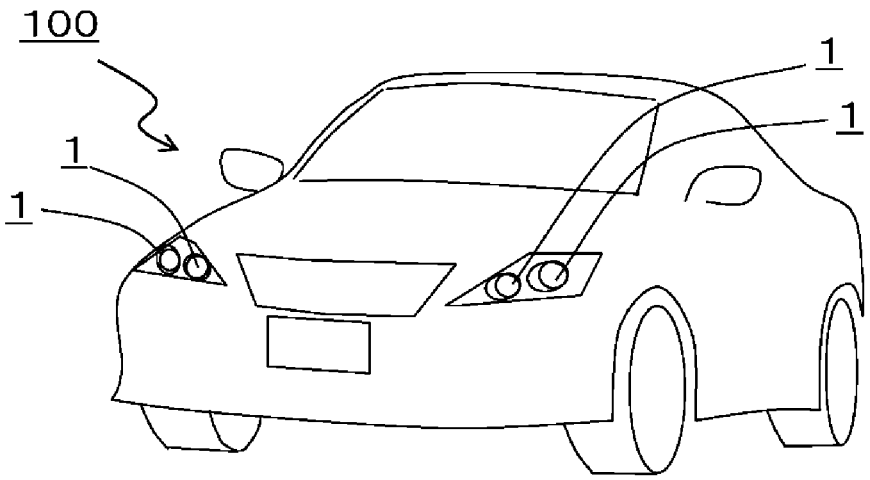
FIG. 6 is a view for describing a vehicle using the lighting apparatus.
Figure 7:
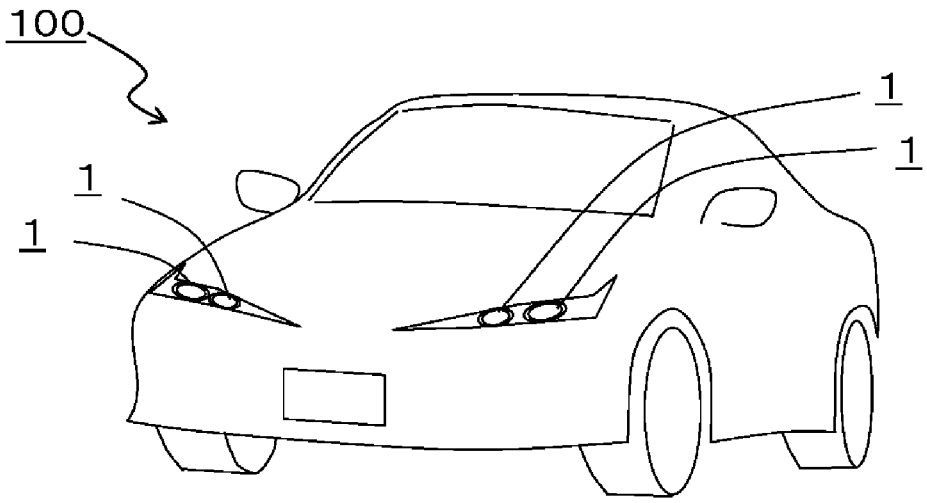
FIG. 7 is a view for describing a vehicle using the lighting apparatus.

As an example of a vehicle to which the above lighting apparatus 1 is mounted as its head lamp, vehicle 100 illustrated in FIG. 6 and vehicle 100 illustrated in FIG. 7 will be shown. The shape of the headlight of vehicle 100 illustrated in FIG. 7 is thinner than that of the vehicle in FIG. 6.

As illustrated in FIGS. 6 and 7, vehicle 100 having the above lighting apparatus 1 as a head lamp and including a power source which is electrically connected to light source 10 and controller 90 can project projection light 85 projected from lighting apparatus 1 in any direction, thereby being capable of enhancing visibility to an object during running and visibility of an oncoming vehicle to an object.

As an example of the vehicle having above lighting apparatus 1 as a head lamp, vehicle 100 illustrated in FIG. 6 and vehicle 100 illustrated in FIG. 7 have been described. However, both vehicle 100 illustrated in FIG. 6 and vehicle 100 illustrated in FIG. 7 can provide similar effect relating to the above light distribution control.

A light source having high directionality of emission light, such as laser, especially nitride semiconductor laser element, can be used for light source 10, for example. Such light source has higher emission efficiency and smaller emission area than LED or lamp, so that light source 10 can be configured with a compact optical system. Thus, lighting apparatus 1 can be made compact, can be high in efficiency, and can be low in cost.

As a result, a freedom in design upon using lighting apparatus 1 as a head lamp is increased, whereby a novel design, such as a thinner head lamp in vehicle 100 illustrated in FIG. 7, can be employed.

Figure 8:
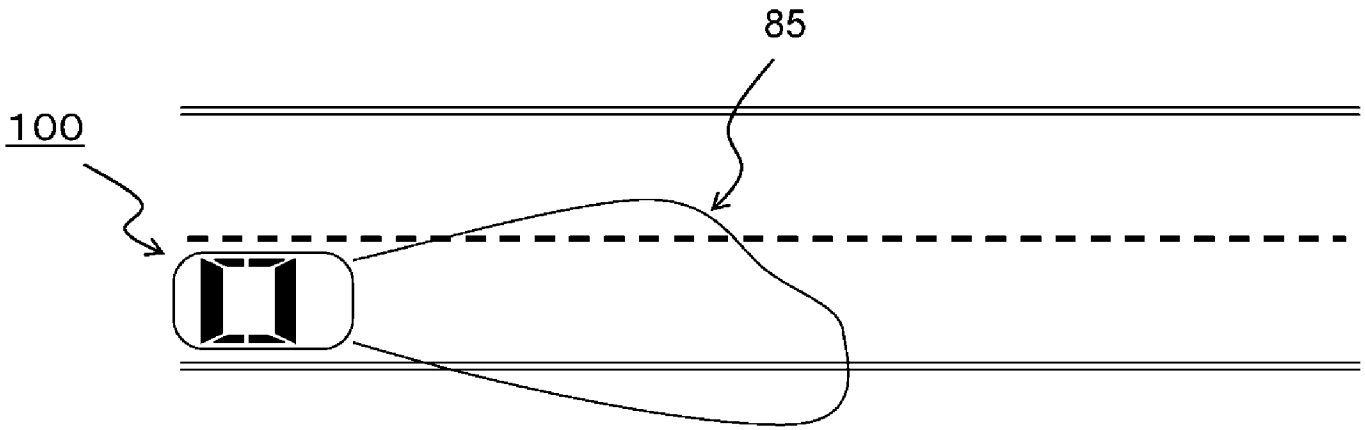
FIG. 8 is a view for describing a function of a vehicle using the lighting apparatus.
Figure 9:
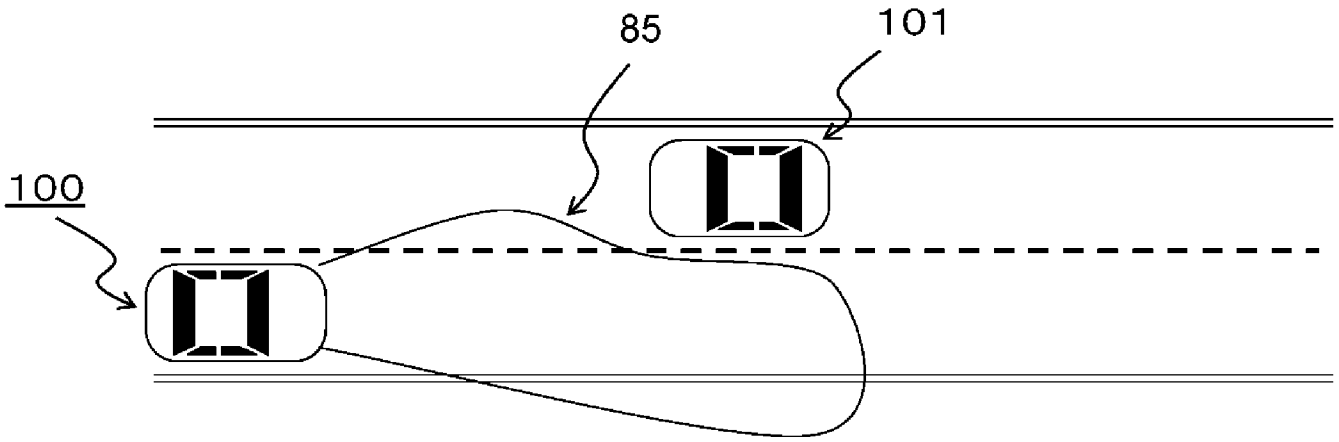
FIG. 9 is a view for describing a function of a vehicle using the lighting apparatus.

In addition, as illustrated in FIGS. 6 and 7, vehicle 100 having above lighting apparatus 1 as a head lamp and a power source electrically connected to light source 10 and controller 90 can project projection light 85 projected from lighting apparatus 1 in any direction, thereby being capable of enhancing visibility to an object during running and visibility of an oncoming vehicle to an object. More specifically, as illustrated in FIGS. 8 and 9, light distribution of the head lamp can be changed depending on the case where oncoming vehicle 101 is on a road and the case where it is not on the road, for example. With this, visibility of the running vehicle (vehicle 100) can be maintained without deteriorating visibility of oncoming vehicle 101 due to light of the head lamp of the running vehicle (vehicle 100). In addition, the present exemplary embodiment can provide a lighting apparatus that can control light distribution without using a mechanical component, thereby being capable of implementing a compact lighting apparatus. Accordingly, the present exemplary embodiment can allow a head lamp to be more freely designed as illustrated in FIGS. 6 and 7.

Modification

Figure 10:
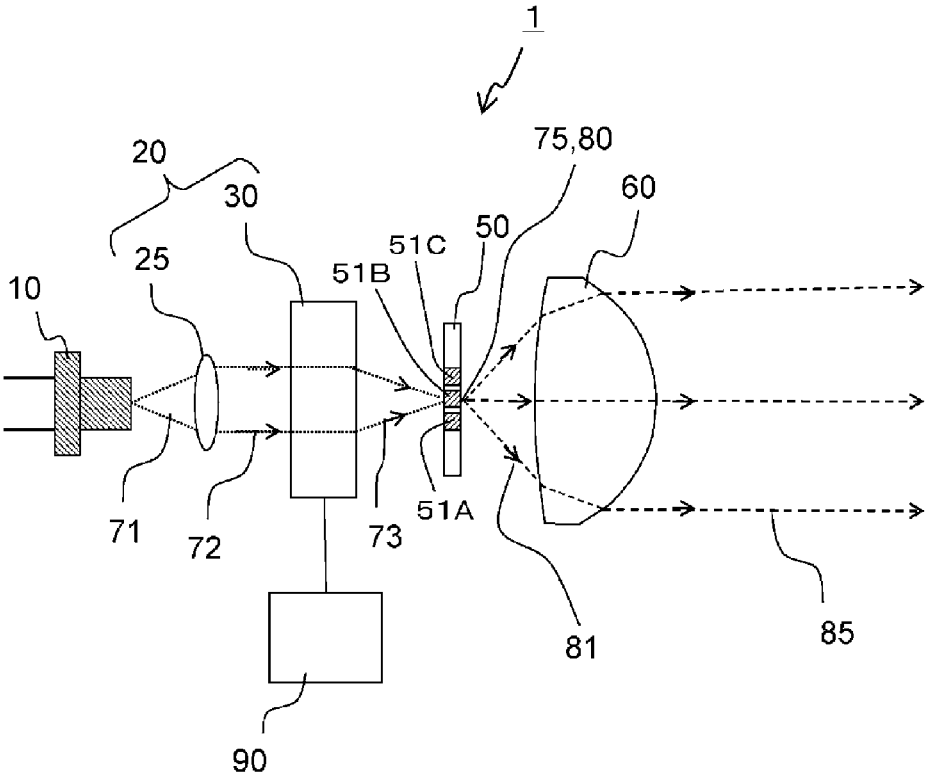
FIG. 10 is a schematic sectional view illustrating a configuration of a lighting apparatus according to a modification of the first exemplary embodiment of the present disclosure.

Next, a modification of the first exemplary embodiment will be described with reference to FIGS. 10 to 12. In the present modification, a lighting apparatus has almost similar configuration to the above lighting apparatus, and different points will only be described.

Compared to the lighting apparatus illustrated in FIG. 1, the structure of wavelength conversion element 50 is different in the present modification. As illustrated in FIG. 12, wavelength conversion element 50 includes a base 52 made of an aluminum alloy material, for example, and through-hole 52A, through-hole 52B, and through-hole 52C which are formed on base 52. Light conversion portion 51A, light conversion portion 51B, and light conversion portion 51C, which are made of a phosphor converting a wavelength of emission light emitted from light source 10 into a long wavelength for performing wavelength conversion, are respectively provided on through-hole 52A, through-hole 52B, and through-hole 52C. Specifically, the emission light from light source 10 is supposed to have a main emission wavelength within the range of 420 nm to 500 nm. Light conversion portion 51A, light conversion portion 51B, and light conversion portion 51C are formed such that a phosphor converting light with a main wavelength ranging from 420 nm to 500 nm into light with a main wavelength ranging from 500 nm to 700 nm is mixed in a binder made of organic material such as silicone or epoxy or in a binder made of inorganic material such as low-melting-point glass, aluminum oxide, or zinc oxide. Specific examples of the phosphor include Ce-activated garnet crystal phosphor ($(Y, Gd)_3(Ga, Al)_5O_{12}:Ce^{3+}$ phosphor) and Eu-activated $(Ba, Sr)Si_2O_2N_2$ phosphor.

Dichroic mirror 53 transmitting light with a wavelength of 500 nm or lower and reflecting light with a wavelength of 500 nm or higher is provided to be in contact with the surface of base 52, close to condenser 20, in wavelength conversion element 50. Dichroic mirror 53 is formed such that a filter which is a dielectric multilayer film, for example, is formed on a transparent substrate such as glass, or sapphire or aluminum nitride.

In the present modification, power applied to the plurality of electrodes formed on condenser lens 30 is changed to allow first light 71 to enter any one of light conversion portion 51A, light conversion portion 51B, and light conversion portion 51C. For example, first light 71 enters light conversion portion 51B disposed on a principal axis in FIG. 10. In this case, second light 81 becomes projection light 85 along the principal axis with projection lens 60, and is radiated.

Figure 11:
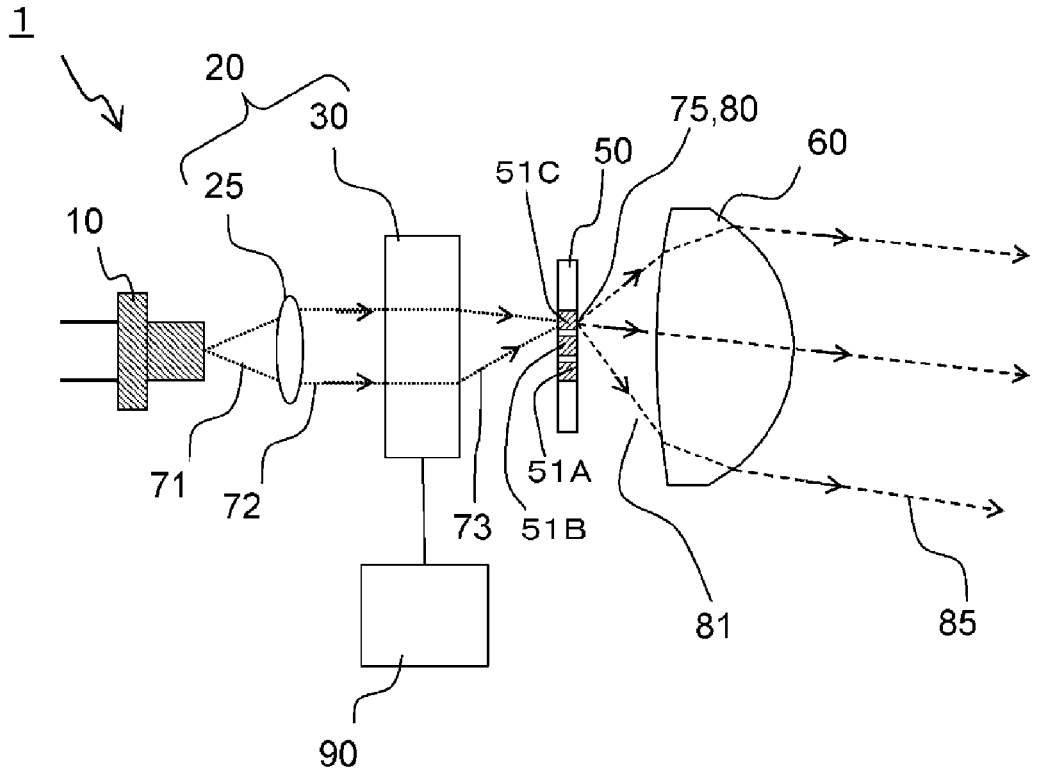
FIG. 11 is a schematic sectional view illustrating a configuration and operation of the lighting apparatus according to the modification.
Figure 12:
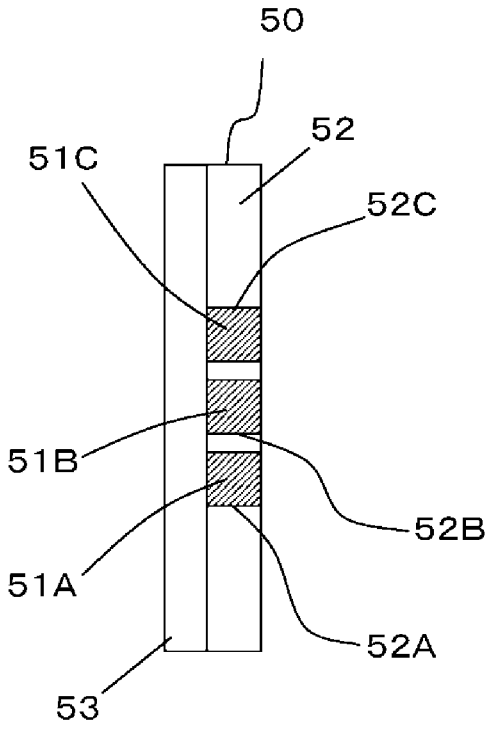
FIG. 12 is a schematic sectional view illustrating a configuration of a wavelength conversion element of the lighting apparatus according to the modification.

In FIG. 11, first light 71 enters light conversion portion 51C located at an off-center position relative to the principal axis. In this case, second light 81 becomes projection light 85 having an angle relative to the principal axis with projection lens 60, and is radiated.

In this configuration, the phosphor of wavelength conversion element 50 is formed on through-hole 52A, through-hole 52B, and through-hole 52C, each of which has a side face made of an alumina alloy having high optical reflectivity. In addition, dichroic mirror 53 reflecting light emitted from the phosphor is disposed at the light incident side. With this configuration, projection light having high conversion from first light to second light can easily be obtained, and the radiation direction of the projection light can easily be changed.

In the present modification as well, the emission wavelength of light emitted from light source 10 and the material of the wavelength conversion element can be changed in the similar way as in the first exemplary embodiment. In this case, when light emitted from light source 10 has an emission wavelength ranging from 380 nm to 420 nm, the characteristic of dichroic mirror 53 disposed on wavelength conversion element 50 may be set according to emission wavelength such that light with a wavelength of 420 nm or lower is transmitted and light with a wavelength of 420 nm or higher is reflected.

Second Exemplary Embodiment

Figure 13:
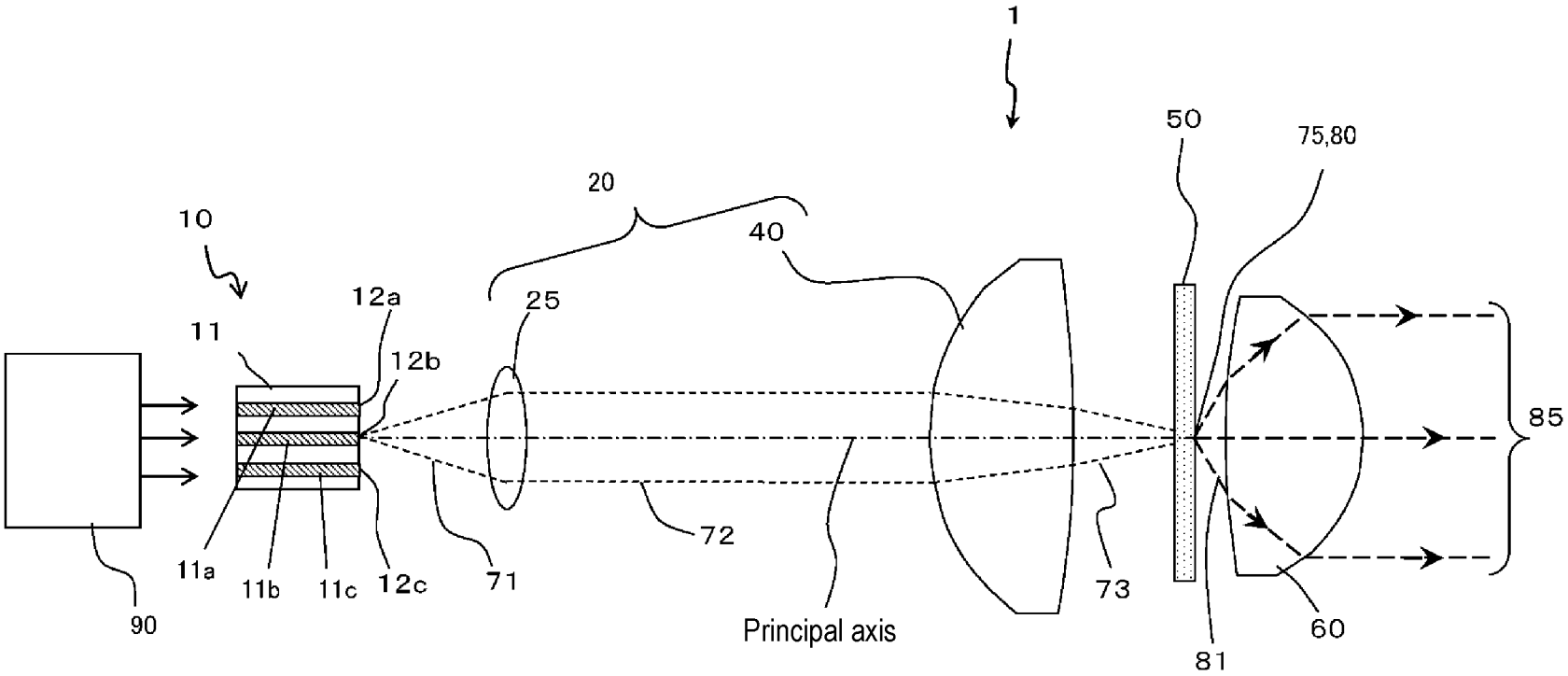
FIG. 13 is a schematic view illustrating a configuration and operation of a lighting apparatus according to a second exemplary embodiment of the present disclosure.
Figure 14:
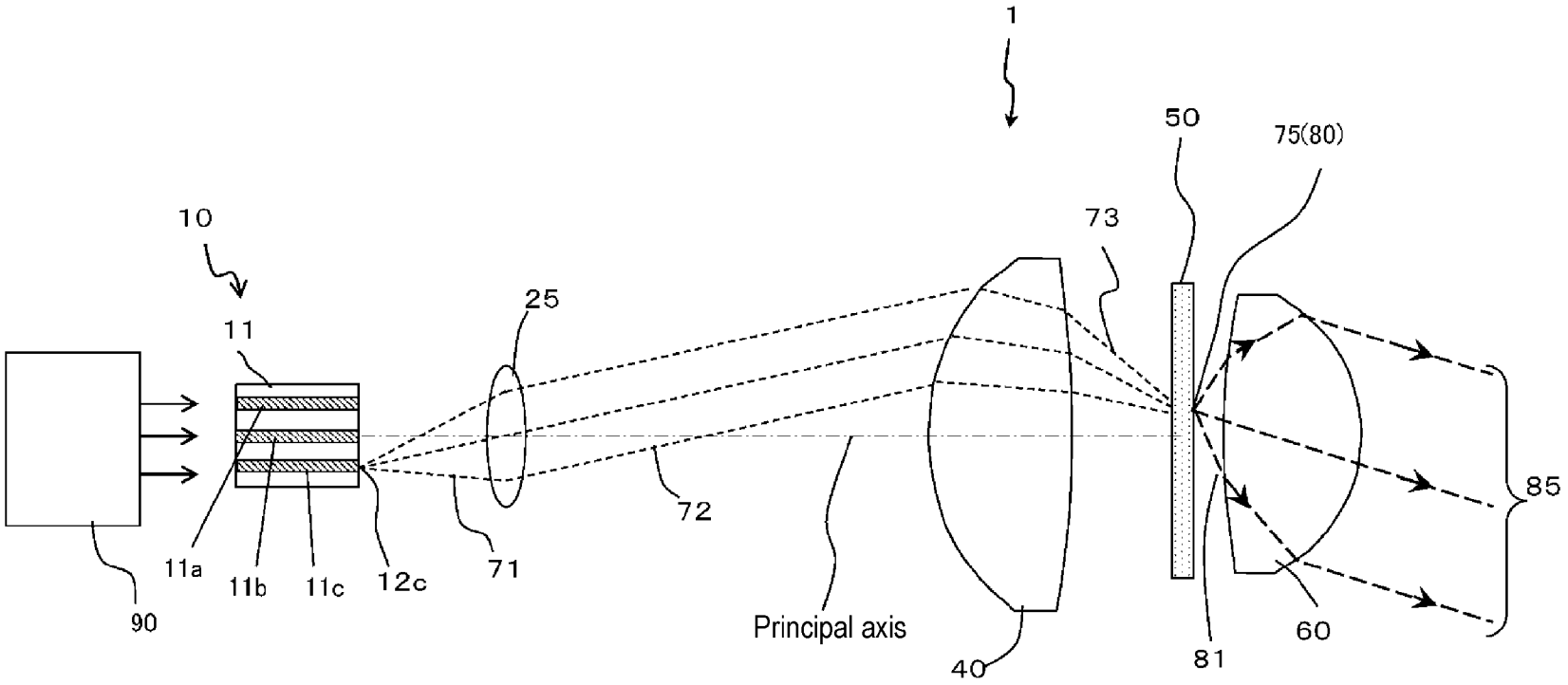
FIG. 14 is a schematic view illustrating the configuration and operation of the lighting apparatus.
Figure 15:
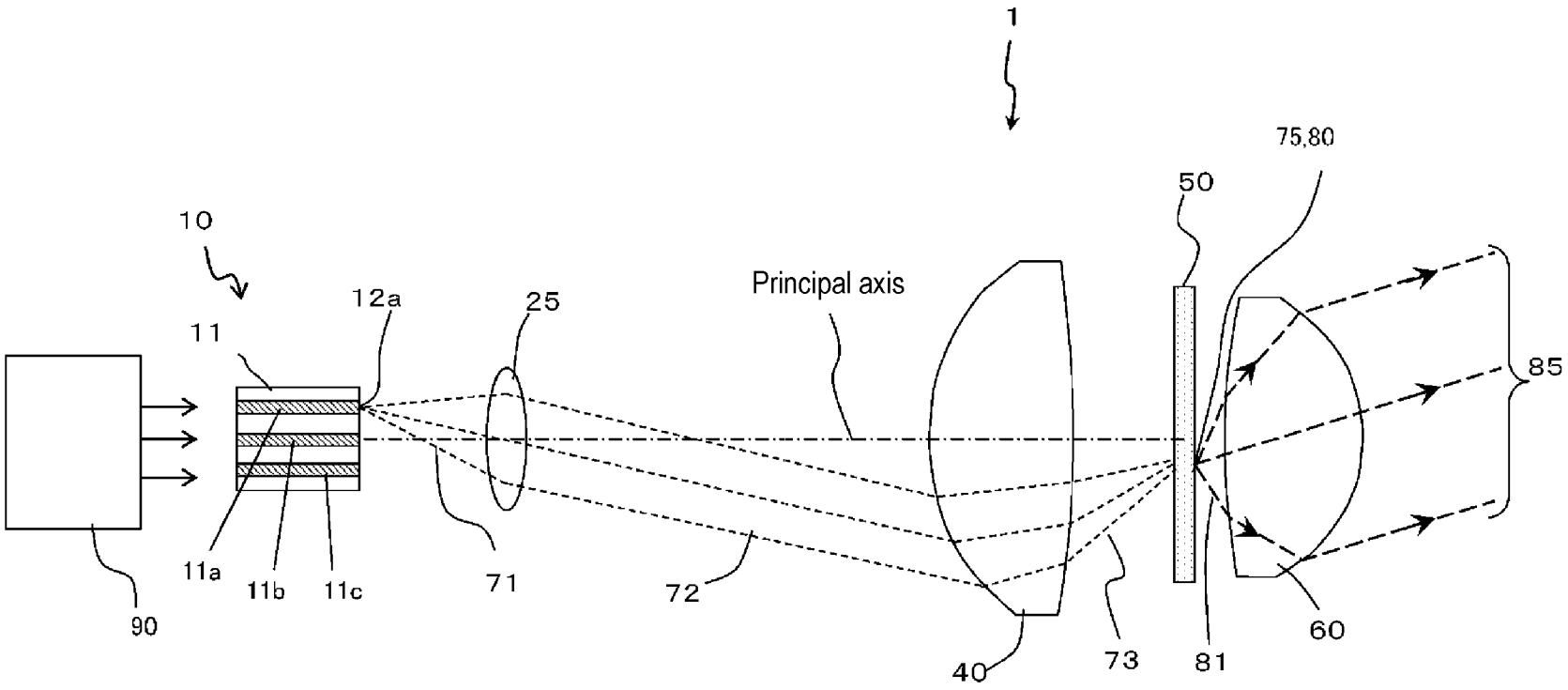
FIG. 15 is a schematic view illustrating the configuration and operation of the lighting apparatus.
Figure 16A:
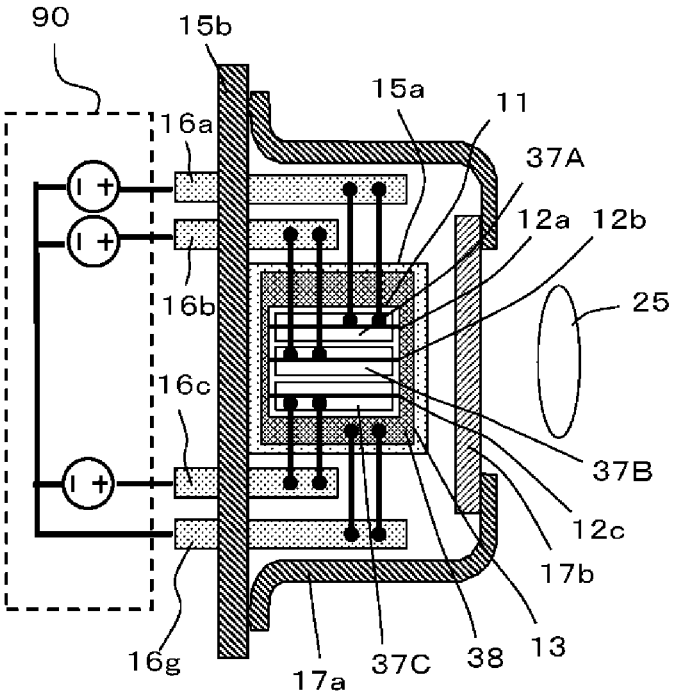
FIG. 16A is a schematic sectional view illustrating a configuration of a light source of the lighting apparatus.

Next, a configuration of a lighting apparatus according to the second exemplary embodiment will be descried with reference to FIGS. 13 to 15, 16A, and 16B. As illustrated in FIG. 13, lighting apparatus 1 according to the second exemplary embodiment includes: light source 10; condenser 20 that converges first light 71 emitted from light source 10 onto predetermined focal position 75 of wavelength conversion element 50 as converged light 73; and wavelength conversion element 50 that receives converged light 73 and emits second light 81. The lighting apparatus further includes projection lens 60 that projects second light 81 as projection light 85, and a plurality of fixed electrodes for changing focal position 75 with a control signal. In the present exemplary embodiment, condenser 20 includes one or more lenses. In the present exemplary embodiment, condenser 20 includes collimator lens 25 and condenser lens 40. The plurality of electrodes are formed on light source 10. Specifically, as illustrated in FIG. 16A, the plurality of electrodes include first electrode 37A, second electrode 37B, and third electrode 37C, which are formed on semiconductor light-emitting element 11 composing light source 10, and common electrode 38 formed on sub-mount 13.

Detailed Configuration

Figure 16B:
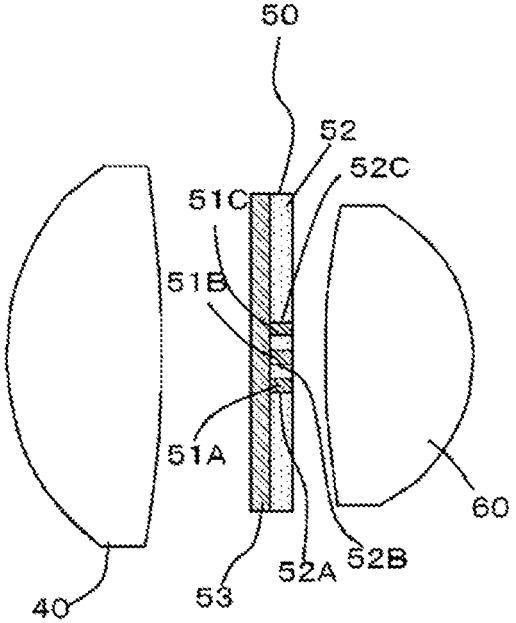
FIG. 16B is a schematic sectional view illustrating a configuration around an optical system in the lighting apparatus.

FIGS. 16A and 16B are schematic sectional views illustrating an example of detailed structures of light source 10 and an optical system of lighting apparatus 1 according to the second exemplary embodiment. In the present exemplary embodiment, light source 10 has semiconductor light-emitting element 11 mounted in package 19 including post 15*a*, base 15*b*, lead pin 16*a*, lead pin 16*b*, lead pin 16*c*, and lead pin 16*g*, for example, as illustrated in FIG. 16A.

Semiconductor light-emitting element 11 has a structure in which a semiconductor layer is laminated on a substrate, and semiconductor light-emitting element 11 emits light with a wavelength ranging from 380 nm to 499 nm. Specifically, a semiconductor layer that is nitride of Group III element (Al, Ga, In) is laminated on a substrate that is an n-type GaN substrate in the order of an n-type clad layer, n-type optical guide layer, InGaN quantum well layer, p-type optical guide layer, electron block layer, p-type clad layer, and p-type electrode contact layer.

Optical waveguide 11*a*, optical waveguide 11*b*, and optical waveguide 11*c*, which are formed on semiconductor light-emitting element 11, are made of ridge stripe of semiconductor laser, for example. For example, optical waveguides 11*a* to 11*c* are formed with pattern formation with a semiconductor photolithography or dry etching. Specifically, a $SiO_2$ film not illustrated is formed on a surface of a wafer on which a semiconductor layer is laminated with chemical vapor deposition (CVD) or the like. Mask patterning of ridge stripe is performed to this $SiO_2$ film with a photolithography, and a plurality of ridge-like stripe structures are formed with dry etching. With this, a plurality of optical waveguides (optical waveguide 11*a*, optical waveguide 11*b*, and optical waveguide 11*c*) can easily be formed on one semiconductor light-emitting element 11 in the present exemplary embodiment.

Any one or more of metals of Pd, Pt, Ni, Ti, and Au are vapor deposited or patterned to form first electrode 37A, second electrode 37B, and third electrode 37C on the stripe structures. Accordingly, a plurality of electrodes can easily be connected to the plurality of optical waveguides.

First electrode 37A, second electrode 37B, and third electrode 37C can easily electrically be connected to lead pin 16*a*, lead pin 16*b*, and lead pin 16*c* respectively with fine metal wires which are gold wires, and can be electrically isolated from one another.

Package 19 includes base 15*b* made of iron or copper, for example, and post 15*a* formed on the base 15*b*, post 15*a* being made of iron or copper, for example, and having sub-mount 13 and semiconductor light-emitting element 11 mounted thereon. An aperture is formed on base 15*b*, and lead pin 16*a*, lead pin 16*b*, lead pin 16*c*, and lead pin 16*g* are fixed through an insulating material not illustrated. Lead pin 16*a*, lead pin 16*b*, lead pin 16*c*, and lead pin 16*g* are connected to wiring lines disposed at base 15*b* at the opposite side of post 15*a* for connection to controller 90. Common electrode (counter electrode) 38 is formed on sub-mount 13. Common electrode 38 electrically connects the surface of semiconductor light-emitting element 11 opposite to first electrode 37A to lead pin 16*g* through the fine metal wire.

Cap 17*a* provided with translucent window 17*b* is mounted to light source 10 in airtight manner so as to seal semiconductor light-emitting element 11.

As illustrated in FIG. 16B, wavelength conversion element 50 includes base 52 made of an aluminum alloy and formed with apertures 52A, 52B, and 52C into which light conversion portions 51A, 51B, and 51C containing blue phosphor and yellow phosphor are buried, for example. Dichroic mirror 53 for efficiently reflecting light emitted from light conversion portion 51A, light conversion portion 51B, and light conversion portion 51C to projection lens 60 is disposed on base 52 at the side of condenser lens 40.

Semiconductor light-emitting element 11 emits laser light having a main wavelength of 405 nm, for example, from emission point 12*a*, emission point 12*b*, and emission point 12*c*, each of which is connected to each of three optical waveguides. Dichroic mirror 53 is configured such that a dielectric multilayer film transmitting light with a wavelength of 430 nm or lower and reflecting light with a wavelength of 430 nm or higher is formed on a transparent substrate made of glass or sapphire.

Projection lens 60 is disposed on wavelength conversion element 50 at the position opposite to condenser lens 40. Projection lens 60 is an optical element including one lens or a lens group including a plurality of lenses, and is set to have high numerical aperture (NA), such as 0.8 or higher, for efficiently receiving fluorescence or emission light, i.e., diffusion light, which is radiated from wavelength conversion element 50.

(Light Distribution Control)

Next, a method for controlling lighting apparatus 1 according to the present exemplary embodiment will be described with reference to FIGS. 13 to 15. First light which is not illustrated and emitted from emission point 12*a*, emission point 12*b*, and emission point 12*c*, passes through collimator lens 25 and condenser lens 40 to be precisely converged on each of light conversion portion 51A, light conversion portion 51B, and light conversion portion 51C of wavelength conversion element 50.

Controller 90 connected to light source 10 independently applies power to optical waveguides connected to emission point 12*a*, emission point 12*b*, and emission point 12*c* through first electrode 37A, second electrode 37B, and third electrode 37C.

FIG. 13 is a view for describing the case in which power is supplied to only second electrode 37B. First light 71 emitted from emission point 12*b* is converged on light conversion portion 51B of wavelength conversion element 50 by collimator lens 25 and condenser lens 40. First light 71 is converted into second light 81 in which, for example, blue light and yellow light are mixed at light conversion portion 51B, collected by condenser lens 40, and radiated to the outside of lighting apparatus 1 as white projection light 85. In this case, projection light 85 is radiated as projection light emitted along a principal axis.

FIG. 14 is a view for describing the case in which power is supplied to only third electrode 37C. First light 71 emitted from emission point 12*c* is converged on focal position 75 located at the position shifted from the principal axis of wavelength conversion element 50. First light 71 is converted into second light 81 in which, for example, blue light and yellow light are mixed at wavelength conversion element 50 with focal position 75, collected by projection lens 60, and radiated to the outside of lighting apparatus 1 as white projection light 85. In this case, projection light 85 is radiated as projection light having an angle relative to the principal axis.

FIG. 15 is a view for describing the case in which power is supplied to only first electrode 37A. First light 71 emitted from emission point 12*a* is converged on focal position 75 located at the position shifted from the principal axis of wavelength conversion element 50 in the direction opposite to the direction in FIG. 14. First light 71 is converted into second light 81 in which, for example, blue light and yellow light are mixed at wavelength conversion element 50 with focal position 75, collected by condenser lens 40, and radiated to the outside of lighting apparatus 1 as white projection light 85 by dichroic mirror 53. In this case, projection light 85 is radiated as projection light having an angle relative to the principal axis in the direction opposite to the direction in FIG. 14.

As described above, power is independently applied to first electrode 37A, second electrode 37B, and third electrode 37C, and the amount of the power is adjusted, whereby the radiation direction of projection light emitted from lighting apparatus 1 can optionally be changed. The change in the direction of lighting apparatus 1 can be performed without using a mechanical component. Therefore, the radiation direction of projection light can easily be changed, and durability of lighting apparatus 1 can be enhanced.

The method for supplying power to any one of first electrode 37A, second electrode 37B, and third electrode 37C has been described above. However, the method is not limited thereto. For example, there are a method for supplying power to both of first electrode 37A and second electrode 37B, and a method for supplying power to both of first electrode 37A and second electrode 37B wherein a half of the power to first electrode 37A is supplied to second electrode 37B. With these methods, an optional light distribution pattern can be formed by independently and freely supplying power to first electrode 37A, second electrode 37B, and third electrode 37C.

In the above description of the operation, wavelength conversion element 50 includes phosphor as in the first exemplary embodiment, for example (see the above (Method for generating second light)).

In the above, the emission light of semiconductor light-emitting element 11 may be set as blue light with a wavelength from 430 nm to 500 nm, and light conversion portion 51A, light conversion portion 51B, and light conversion portion 51C of wavelength conversion element 50 may be configured as light conversion portions including phosphor having a main wavelength ranging from 500 nm to 660 nm of the emission light. With this, the first light may be radiated as second light with the wavelength of a part or all of the first light being changed with the phosphor. With this configuration, a part of light emitted from semiconductor light-emitting element 11 can be radiated as second light. In this case, dichroic mirror 53 is desirably designed to have property in consideration of polarizing property so as to transmit first light 71 that is polarized light and to reflect a part of a blue light component of second light 81 that is unpolarized light.

Third Exemplary Embodiment

Lighting apparatus 1 according to a third exemplary embodiment of the present disclosure will be described below with reference to FIGS. 17 to 19. The lighting apparatus according to the present exemplary embodiment will be described mainly for a part different from the lighting apparatus according to the second exemplary embodiment.

Figure 17:
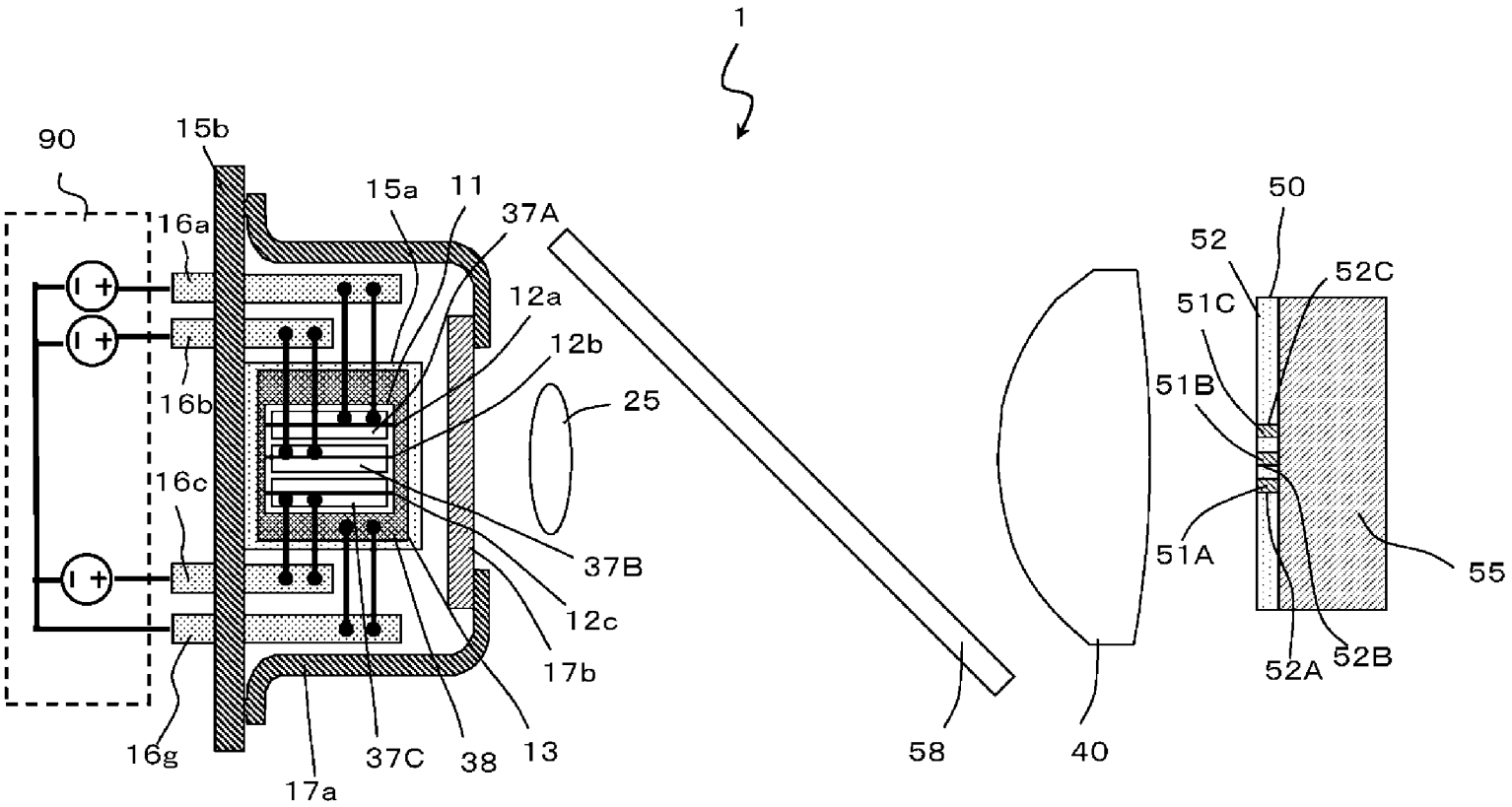
FIG. 17 is a schematic sectional view illustrating a configuration of a light source and a configuration around an optical system in a lighting apparatus according to a third exemplary embodiment of the present disclosure.

FIG. 17 is a schematic sectional view illustrating a structure of lighting apparatus 1 according to the third exemplary embodiment. In the present exemplary embodiment, a semiconductor light-emitting element has three optical waveguides, and a wavelength conversion element has three light conversion portions, as in the second exemplary embodiment. In lighting apparatus 1 according to the present exemplary embodiment, structures or functions of wavelength conversion element 50, condenser lens 40, and dichroic mirror 58 are mainly different from the second exemplary embodiment.

Wavelength conversion element 50 includes base 52 made of an aluminum alloy and formed with apertures 52A, 52B, and 52C into which light conversion portions 51A, 51B, and 51C containing blue phosphor and yellow phosphor are buried, for example. Heat dissipation unit 55 for efficiently dissipating heat generated at the light conversion portions is mounted to base 52 on the position opposite to condenser lens 40. Semiconductor light-emitting element 11 has optical waveguides respectively connected to three emission points 12*a*, 12*b*, and 12*c*, and emits laser light having a main wavelength present within the range of from 400 nm to 410 nm, for example. Collimator lens 25, dichroic mirror 58, and condenser lens 40 are disposed between light source 10 and wavelength conversion element 50. Dichroic mirror 58 is configured such that a dielectric multilayer film transmitting light with a wavelength of 430 nm or lower and reflecting light with a wavelength of 430 nm or higher is formed on a glass plate, the light being incident from the direction of 45 degrees.

First light which is not illustrated and emitted from emission point 12*a*, emission point 12*b*, and emission point 12*c*, passes through collimator lens 25, dichroic mirror 58, and condenser lens 40 to be precisely converged on each of light conversion portion 51A, light conversion portion 51B, and light conversion portion 51C of wavelength conversion element 50.

Controller 90 connected to light source 10 independently applies power to optical waveguides connected to emission point 12*a*, emission point 12*b*, and emission point 12*c* through first electrode 37A, second electrode 37B, and third electrode 37C.

Figure 18:
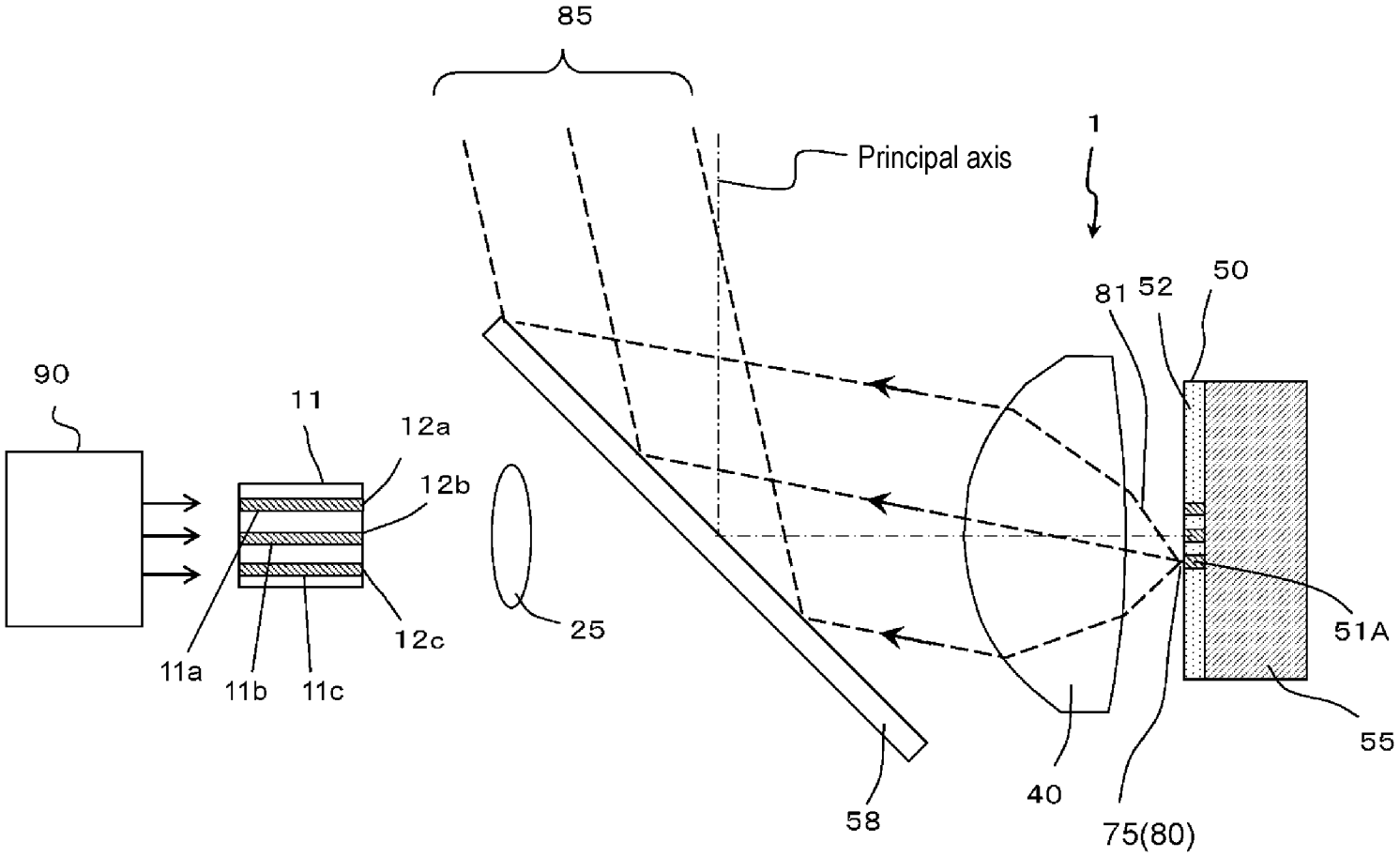
FIG. 18 is a schematic sectional view illustrating a configuration of the lighting apparatus.

FIG. 18 is a view for describing the case in which power is supplied to only first electrode 37A. Unillustrated first light emitted from emission point 12*a* is converged on light conversion portion 51A by condenser lens 40. The unillustrated first light is converted into second light 81 in which, for example, blue light and yellow light are mixed at light conversion portion 51A, and the resultant light is radiated toward condenser lens 40. Second light 81 is collected by condenser lens 40, and radiated to the outside of lighting apparatus 1 as white projection light 85 by dichroic mirror 58. In this case, projection light 85 is emitted as projection light having an angle relative to the principal axis.

With this configuration, the same lens can be used for the condenser lens for converging the first light and for the condenser lens for collecting the second light, whereby the configuration of the lighting apparatus can be simplified. In addition, heat generated upon the conversion of the first light into the second light can efficiently be dissipated with heat dissipation unit 55 of the wavelength conversion element, whereby durability of the wavelength conversion element can be enhanced.

Figure 19:
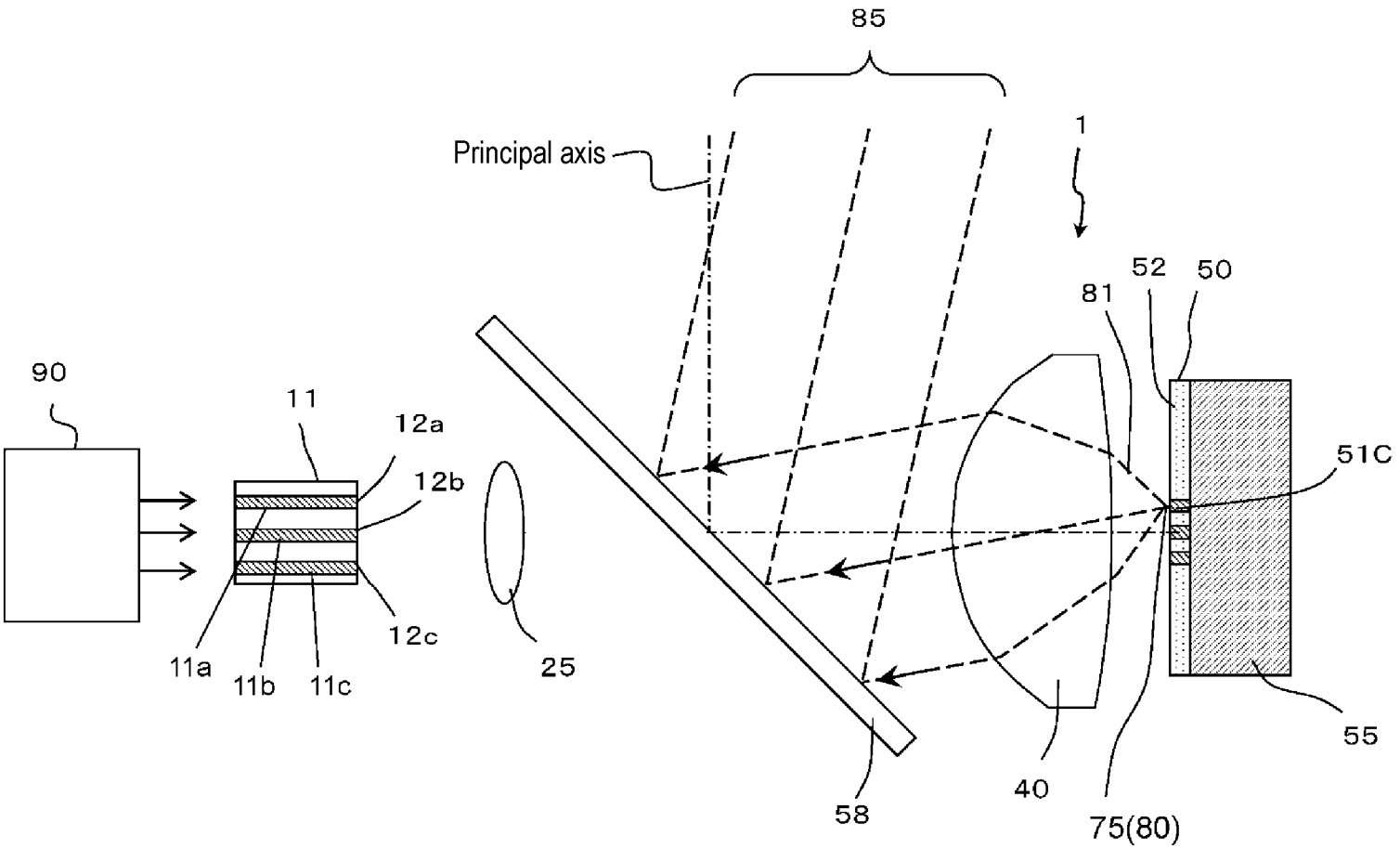
FIG. 19 is a schematic sectional view illustrating the configuration and operation of the lighting apparatus.
Figure 20:
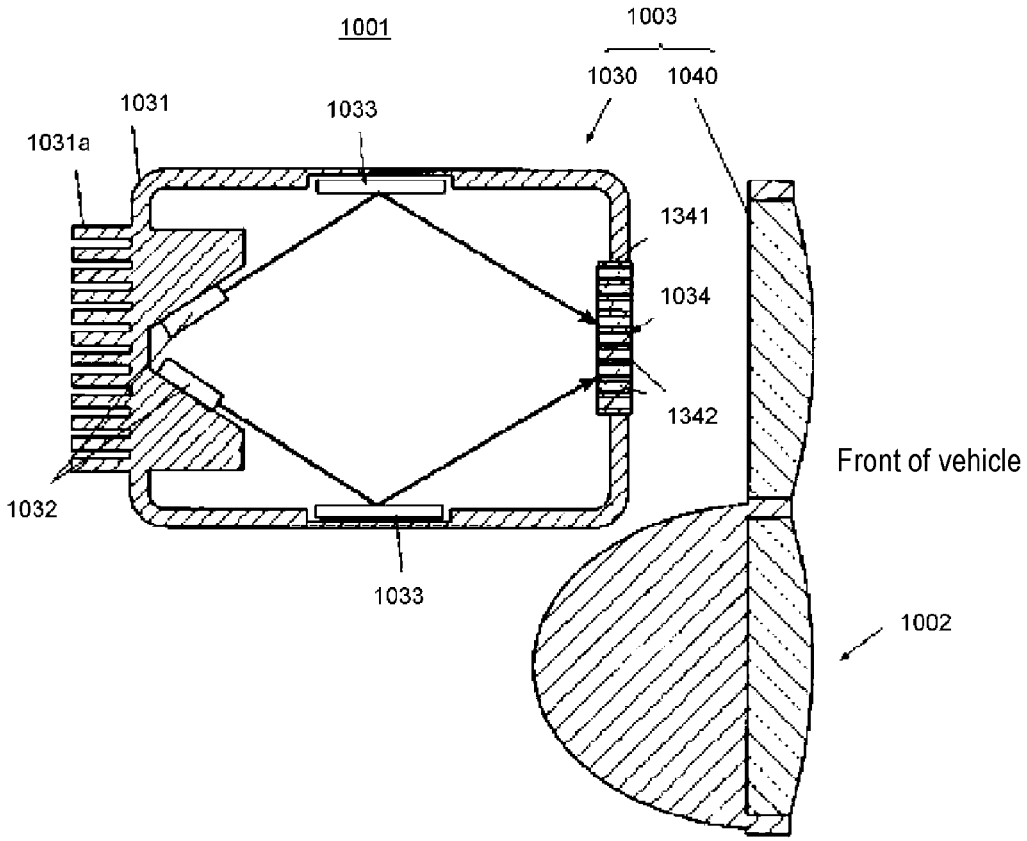
FIG. 20 is a view for describing a conventional lighting apparatus.

FIG. 19 is a view for describing the case in which power is supplied to only third electrode 37C. Unillustrated first light emitted from emission point 12*c* is converged on light conversion portion 51C. Unillustrated first light is converted into second light 81 in which, for example, blue light and yellow light are mixed at light conversion portion 51C, collected by condenser lens 40, and radiated to the outside of lighting apparatus 1 as white projection light 85 by dichroic mirror 58. In this case, projection light 85 is radiated as projection light having an angle relative to the principal axis in the direction opposite to the direction in FIG. 18.

As described above, power is independently applied to first electrode 37A, second electrode 37B, and third electrode 37C, and the amount of the power is adjusted, whereby the radiation direction of projection light emitted from lighting apparatus 1 can optionally be changed. In this case, lighting apparatus 1 does not include mechanical components as a constitute element. Therefore, the radiation direction of projection light can easily be changed, and durability of lighting apparatus 1 can be enhanced.

The method for supplying power to any one of first electrode 37A, second electrode 37B, and third electrode 37C has been described above. However, the method is not limited thereto. For example, there are a method for supplying power to both of first electrode 37A and second electrode 37B, and a method for supplying power to both of first electrode 37A and second electrode 37B wherein a half of the power to first electrode 37A is supplied to second electrode 37B. With these methods, an optional light distribution pattern can be formed by independently and freely supplying power to first electrode 37A, second electrode 37B, and third electrode 37C.

In the above, the emission light of semiconductor light-emitting element 11 may be set as blue light with a wavelength ranging from 430 nm to 500 nm, and light conversion portions 51A, 51B, and 51C of wavelength conversion element 50 may be configured as light conversion portions including phosphor having a main wavelength ranging from 500 nm to 660 nm of the emission light. With this, the first light may be radiated as second light with the wavelength of a part or all of the first light being changed with the phosphor. With this configuration, a part of light emitted from semiconductor light-emitting element 11 can be radiated as second light. In this case, dichroic mirror 58 is desirably designed to have property in consideration of polarizing property so as to transmit first light that is polarized light and to reflect a part of a blue light component of second light 81 that is unpolarized light.

In the above second and third exemplary embodiments, the number of the optical waveguides of the semiconductor light-emitting element is set to be three. However, it is not limited thereto. The number of the optical waveguides may be two according to usage. Alternatively, the number of the optical waveguides of the semiconductor light-emitting element may be four or more for enabling light distribution control more freely.

In the first to third exemplary embodiments, an aluminum alloy is used for the material of the base of the wavelength conversion element. However, it is not limited thereto. A material which has high thermal conductivity for exhausting heat generated on the phosphor composing the light conversion portion, and reflects visible light radiated from the light conversion portion may preferably be used. For example, a material formed by performing nickel plating or silver plating on a copper surface may be used.

In the first to third exemplary embodiments, the semiconductor light-emitting element is specified as semiconductor laser. However, a semiconductor light-emitting element which radiates emission light having high directionality, such as a superluminescent diode, may be used.

In the first to third exemplary embodiments, light emitted from the lighting apparatus is white light. However, it is not limited to white light and it is applicable to a light source having low color temperature, such as a light source with a color close to orange or pale yellow color, which is called bulb color, or a light source having high color temperature such as a light source with a color close to blue, on the contrary.

The lighting apparatus, vehicle, and control method for the lighting apparatus of the present disclosure provide effects of easily performing a light distribution control, and improving durability of the lighting apparatus, and thus useful.

What is claimed is:

1. A lighting apparatus comprising:

a light source;

a wavelength conversion element that receives first light emitted from the light source and emits second light;

a condenser that converges the first light onto a predetermined focal position of the wavelength conversion element;

a projection lens that projects the second light; and a plurality of electrodes that change the focal position with a control signal, wherein the light source has a plurality of optical waveguides, and the plurality of electrodes are respectively connected to the plurality of optical waveguides.

2. The lighting apparatus according to claim 1, wherein the wavelength conversion element includes a plurality of segmented light conversion portions.

3. The lighting apparatus according to claim 2, wherein each of the light conversion portions includes a phosphor.

4. The lighting apparatus according to claim 1, wherein the condenser includes a collimator lens and a condenser lens.

5. A vehicle comprising the lighting apparatus according to claim 1.

6. A method for controlling the lighting apparatus according to claim 1, the method comprising:

providing the lighting apparatus with a controller that independently supplies power to the plurality of electrodes; and changing an amount of power to be supplied to the plurality of electrodes.

* * * * *